United States Patent [19]

Baird, Jr. et al.

[11] Patent Number: 4,541,915

[45] Date of Patent: Sep. 17, 1985

[54] CATALYTIC REFORMING PROCESS

[75] Inventors: William C. Baird, Jr.; Charles H. Mauldin, both of Baton Rouge, La.

[73] Assignee: Exxon Research and Engineering Co., Florham Park, N.J.

[21] Appl. No.: 656,714

[22] Filed: Oct. 1, 1984

[51] Int. Cl.[4] ..... C10G 35/04; C10G 35/09; C10G 35/22

[52] U.S. Cl. ..... 208/65; 208/154; 208/139; 502/241; 585/951

[58] Field of Search ..... 208/154, 65, 64, 139; 502/241; 585/951

[56] References Cited

U.S. PATENT DOCUMENTS

| | | | |
|---|---|---|---|
| 3,347,777 | 10/1967 | Davis, Jr. | 208/65 |
| 3,573,199 | 3/1971 | McCoy | 208/65 X |
| 3,669,875 | 6/1972 | Plank et al. | 208/65 |
| 3,684,692 | 8/1972 | Keith | 208/65 |
| 3,776,836 | 12/1973 | Ko et al. | 208/65 |
| 3,776,860 | 12/1973 | Rai | 502/241 X |
| 3,875,047 | 4/1975 | Dalson et al. | 208/65 |
| 3,974,100 | 8/1976 | Kubicek | 502/241 |
| 4,166,024 | 8/1979 | Swan | 208/65 |
| 4,191,633 | 3/1980 | Dauber | 208/139 X |
| 4,369,129 | 1/1983 | Mauldin et al. | 502/241 |

*Primary Examiner*—D. E. Gantz
*Assistant Examiner*—Glenn A. Caldarola
*Attorney, Agent, or Firm*—Llewellyn A. Proctor

[57] ABSTRACT

A start-up procedure wherein a halogenated rhenium-containing catalyst, to improve its performance in reforming naphtha feeds, is contacted with water, added with the hydrogen and said feed. During the start-up period, preferably on initiation of the start-up period after aromatics production has begun, a naphtha feed, hydrogen and water are passed cocurrently through the several reactors of a reforming unit and reacted over the halogenated rhenium-containing catalyst. Water is generally added with the naphtha and hydrogen, preferably to the initial reactor of the series of reactors of the reforming unit, in concentration ranging from about 100 vppm of hydrogen to about 10,000 vppm of hydrogen, preferably from about 100 vppm to about 5000 vppm of hydrogen.

18 Claims, No Drawings

CATALYTIC REFORMING PROCESS

BACKGROUND OF THE INVENTION

I. Field of the Invention

This invention relates to a procedure for obtaining improved yields and stability from halogenated rhenium-containing catalysts, especially halogenated platinum catalysts promoted with rhenium, or rhenium and another metal promoter, or promoters, in a reforming unit for reforming naphtha feeds.

II. Description of the Prior Art

Catalytic reforming, or hydroforming, is a well established industrial process employed by the petroleum industry for improving the octane quality of naphthas, or straight run gasolines, by increasing its aromatics content. In reforming, e.g., a naphthenic or paraffinic feed, is passed over a polyfunctional catalyst, or catalyst which contains an acidic component, e.g., a halide, and a metal hydrogenation-dehydrogenation component, or components, substantially atomically dispersed upon the surface of a porous, inorganic oxide support, notably alumina. Noble metal catalysts, notably platinum, or platinum promoted with one or more additional metals, are currently employed, reforming being defined as the total effect of the molecular changes, or hydrocarbon reactions, produced by dehydrogenation of cyclohexanes and dehydroisomerization of alkylcyclopentanes to yield aromatics; dehydrogenation of paraffins to yield olefins; dehydrocyclization of paraffins and olefins to yield aromatics; isomerization of n-paraffins; isomerization of alkylcycloparaffins to yield cyclohexanes; isomerization of substituted aromatics; and hydrocracking of paraffins which produces gas, and inevitably coke, the latter being deposited on the catalyst.

Polymetallic reforming catalysts which include platinum and one or more promotor metals have now come into wide use. Reforming catalysts which contain platinum promoted with rhenium (e.g., U.S. Pat. Nos. 3,415,737 and 3,558,477), or both rhenium and iridium (e.g., U.S. Pat. Nos. 3,507,780 and 3,578,583), composited with porous inorganic oxide supports, notably alumina, are well known. In commercial reforming operations wherein such catalysts are employed, one or a series of reactors (usually three or four) constitute the heart of the reforming unit. Each reactor is generally provided with a fixed bed, or beds, of the catalyst which receive downflow feed, and each is provided with a preheater or interstage heater, because the reactions which take place are endothermic. During the "on-oil" portion of an operating cycle, a naphtha feed, with hydrogen, usually recycle hydrogen gas, is cocurrently passed through a preheat furnace and reactor, and then in sequence through subsequent interstage heaters and the several catalyst-containing reactors of the series. The sequences of reforming reactions take place as a continuum throughout the series of staged reactors of the reforming unit. The product from the last reactor of the series is separated into a liquid fraction, and a vaporous effluent. The former is recovered as a $C_5+$ liquid product. The latter is a gas rich in hydrogen, and usually contains small amounts of normally gaseous hydrocarbons, from which hydrogen is separated and recycled to the process to minimize coke production.

On initially cutting oil (naphtha) into the unit, i.e., the beginning of the start-up period, gas make, or $C_4-$ hydrocarbon production, is usually high and $C_5+$ hydrocarbon production relatively low. The catalyst during the start-up period is, even when operating conditions are carefully controlled, characterized by high hydrocracking activity which produces considerable $C_4-$ gas, especially methane, with consequent low $C_5+$ liquid production. As the operating run continues, the production of $C_4-$ hydrocarbons decreases, and the production of $C_5+$ hydrocarbons increases and lines out at production levels approximating a steady state operation, at which time the period of start-up is ended. The activity of the catalyst thereafter gradually declines during the remaining on-oil portion of an operating cycle due to the build-up of coke. Accordingly, during operation thereafter, the temperature of the process is gradually raised to compensate for the activity loss of the catalyst caused by the coke deposition. Eventually, however, economics dictate the necessity of reactivating the catalyst. Consequently, in all processes of this type, the oil must be cut out of the unit and the catalyst must necessarily be periodically regenerated by burning off the coke at controlled conditions. After regeneration, and reactivation of the catalyst a new on-oil cycle is begun.

III. Objects

It is an object of this invention to provide a novel process for improving the $C_5+$ liquid yield and stability performance of halogenated rhenium-containing catalysts, especially halogenated rhenium promoted platinum catalysts, employed for reforming naphthas.

A specific object of this invention is to provide a novel start-up procedure for processing naphtha feeds over such catalysts.

IV. The Invention

These objects and others are achieved in accordance with this invention which relates to a start-up procedure wherein a halogenated rhenium-containing catalyst, to improve its performance in reforming naphtha feeds, is contacted with water, added with the hydrogen and said naphtha feed. During the start-up period, preferably on initiation of the start-up period after hydrogen and naphtha have been introduced into the reforming reaction zone and aromatics have begun to form in the reaction product mixture, the naphtha feed, hydrogen and water are passed cocurrently through one or a plurality of serially connected reactors, preferably the latter, and reacted over the halogenated rhenium-containing catalyst. Water is generally added with the naphtha and hydrogen, preferably to the initial reactor (reaction zone) of the series of reactors (reaction zones) of the reforming unit, in concentration ranging from about 100 parts, per million parts by volume (vppm) of hydrogen, to about 10,000 vppm of hydrogen, preferably from about 100 vppm to about 5000 vppm of hydrogen, and contacted with the dry halogenated rhenium-containing catalyst. Suitably, wet hydrogen can be employed, and the wet hydrogen can be added, with naphtha, to the initial reactor of the series, the water being adequate to supply the required level of moisture to the reactor, based on the volume of hydrogen added. On the addition of water to the unit after oil is introduced, and aromatics have begun to form, methane production declines due to a decrease in the hydrocracking activity of the halogenated rhenium-containing catalyst. At the time when the hydrocracking activity of the catalyst, and methane production, begins to level out, the addition of water to the unit is discontinued. On cutting the water out of the unit, dry hydrogen, with naphtha, are then fed into the reactors of the unit to continue the on-oil portion of the operating cycle. Methane production thereafter increases, but does not reach the level attained prior to water addition. A permanent $C_5^+$ yield improvement is obtained by this method of water treatment.

It is widely recognized that water has a severe poisoning effect on rhenium-containing catalysts, especially platinum catalysts promoted with rhenium, or platinum promoted with rhenium and one or more other metal hydrogenation-dehydrogenation components. A dry reforming environent during the on-oil portion of an operating cycle has been considered to be a prerequisite for obtaining optimum catalyst activity and selectivity performance from such catalysts. For this reason, prior to start-up in conventional practice a thoroughly dry, reduced, sulfided, halogenated catalyst is generally charged into the several reactors of a reforming unit, the preparation of such a catalyst being described, e.g., in U.S. Pat. No. 4,369,129 which issued Jan. 18, 1983. Dry hydrogen is then added, the reactors brought as nearly as possible up to operating conditions, and the oil then cut into the unit. Surprisingly however, it has been found in accordance with this invention that improved yields and better stability will be obtained if during start-up, specifically on initiation of reforming reactions (i.e., when aromatics begin to be produced in the unit), water is added with the hydrogen and naphtha to the unit. The presence of water during this brief period will result in improved yields and better stability throughout the on-oil portion of the operating cycle, after the addition of water to the unit has been discontinued and all traces of the added water thereafter purged from the unit by continuation of the operating run at dry conditions.

The water is added to the unit during start-up, preferably at the time oil is introduced into the unit and the reforming reactions have begun. Aromatic hydrocarbons are formed in situ on initiation of the reforming reactions, regardless of the type of naphtha employed as a feed to the unit. The presence of aromatic hydrocarbons in the reaction product mixture during the water addition period is essential to obtain the benefits of this invention. A suitable feed is one containing from about 5 to about 12 carbon atoms, or more preferably from about 6 to about 9 carbon atoms. Petroleum fractions boiling within the range of from about 80° F. to about 450° F., and preferably from about 125° F. to about 375° F., contains hydrocarbons of carbon numbers within these ranges. Typical naphtha fractions contain from about 15 to about 80 vol. % paraffins, both normal and branched, which fall in the range of about $C_5$ to $C_{12}$, from about 10 to 80 vol. % of naphthenes falling within the range of from about $C_6$ to $C_{12}$, and from about 5 to 20 vol. % of aromatics falling within the range of from about $C_6$ to $C_{12}$.

The absolute water level used to bring about these advantages is interrelated with the length of the period of water addition. If the concentration of water employed is relatively high, the length of the period of water addition is relatively short. Conversely, if the concentration of water employed is relatively low, the length of the period of water addition is relatively high. As suggested however, in general water is added to the reforming unit in concentrations ranging from about 100 vppm to about 10,000 vppm, preferably from about 100 vppm to about 5000 vppm, based on hydrogen. For example, a level of 2600 vppm of water added for one-half hour performs quite well. A period of water addition utilizing this level of water for a lesser time period is insufficient to provide optimum results. A longer period of water addition utilizing this level of water provides no further improvement. It is preferred to keep the time of water addition as short as practical. Water addition beyond this period is very undesirable and should be avoided due to the catalyst poisoning and chloride stripping that occurs while water is present. Thus, after adequate exposure of the catalyst to the preferred water level, attainment of dry conditions should be returned to the catalyst environment as soon as possible in order to obtain the full yield and stability credits afforded by this invention. The water treatment should be ended, and dry conditions restored, when during water addition it is ascertained that the hydrocracking activity of the catalyst levels out, and declines; and methane production begins to decline.

Wet conditions during catalyst preparation, or in the reduction and sulfiding of a catalyst, form no part of this invention. The catalyst charged into the unit prior to start-up, as employed in accordance with this invention, is dry, and suitably the catalyst is prepared, reduced, and sulfided to provide a dry catalyst such as described in U.S. Pat. No. 4,369,129, supra. In accordance with that patent a catalyst comprising catalytically active amounts of rhenium, especially platinum and rhenium, composited with a porous refractory inorganic oxide base, notably alumina, was shown to be more selective, and more stable for producing high octane products from gasolines and naphtha at reforming conditions when the catalyst is pretreated in a sequence which includes the steps of oxidation, dry hydrogen reduction, and sulfiding.

Three discrete steps are involved in the procedure described by the patent, to wit: (1) the catalyst is contacted at an elevated temperature of at least about 850° F. with an oxygen-containing gas, preferably air with or without added oxygen, the metal substitutent, or substitutents, constituting the hydrogenation-dehydrogenation component thereof being oxidized sufficient to form rhenium oxide, or rhenium oxide with other metal oxides, dispersed over the catalyst surface. The oxidized catalyst is then (2) reduced with dry hydrogen, or a dry gas containing sufficient hydrogen to reduce the rhenium oxide, or rhenium oxide and other metal oxides, substantially to the zero valent state necessary for optimum intermetallic interaction, and after the oxidation and reduction steps are completed (3) the catalyst is then contacted with a sulfur-containing fluid, gas or liquid, to convert the reduced metal surface substitutents of the catalyst to the sulfide form.

The hydrogen reduction step in the patented process is critical. It is conducted by contacting the catalyst with dry hydrogen at conditions sufficient to remove product water from the catalyst as it is produced, and the reduction is continued until the stream of hydrogen gas leaving said catalyst (i.e., the exit gas) contains less than about 1000 vppm water, preferably less than about 500 vppm water. Essentially all water, even the in situ water formed by the reduction of the metal oxides of the catalyst, is removed in such dry hydrogen reduction step. Thus, in accordance with the invention described in said patent, the duration of contact of the catalyst with dry hydrogen is continued until the catalyst becomes dry, or desiccated, this state being reached when the hydrogen leaving said catalyst contains less than 1000 vppm water, preferably less than 500 vppm water.

Rhenium is an essential catalyst component, and preferably the catalyst is a platinum-containing catalyst which is promoted with rhenium and one or more additional metal components, palladium, copper, iridium, or the like. In preparing such catalysts, it is preferred to deposit the rhenium and platinum metals, or rhenium, platinum and other metals, e.g., the rhenium, platinum and iridium or rhenium, platinum, iridium and other metals or non-metals used as promoters, on a previously pilled, pelleted, beaded, extruded, or sieved particulate support material, suitably by impregnation. Pursuant to the impregnation method, porous refractory inorganic oxides, especially alumina, in dry or solvated state are contacted, either alone or admixed, or otherwise incorporated with a metal or metals-containing solution, or solutions, and thereby impregnated by either the "incipient wetness" technique, or a technique embodying absorption from a dilute or concentrated solution, or solutions, with subsequent filtration or evaporation to effect total uptake of the metallic component, or components.

The impregnation solutions of the rhenium and platinum metal compounds, and rhenium and platinum metals or other compounds used as promoters, are prepared by dissolving the compounds, or salts, in water or other inorganic or organic solvents. The concentration of each of the rhenium and platinum components generally ranges from about 0.01 to 3 percent, preferably from about 0.05 to 1 percent, based on the weight of solution. The pH of the impregnation solution should be controlled to less than about 4, preferably less than 3, by the addition of a suitable inorganic or organic acid. By controlling the pH within these ranges, the components can be effectively dispersed into the inner part of the catalyst. Generally, it is preferred to use a halogen-acid aqueous solution of the noble metals.

To enhance catalyst performance, it is also required to add a halogen component. Fluorine and chlorine are preferred halogen components. The halogen is contained on the catalyst within the range of 0.1 to 3 percent, preferably within the range of about 0.3 to 2 percent, based on the weight of the catalyst. When using chlorine as a halogen component, it is contained on the catalyst within the range of about 0.2 to 2 percent, preferably within the range of about 0.5 to 1.5 percent; based on the weight of the catalyst. The introduction of halogen into a catalyst can be carried out by any method and at any time of the catalyst preparation, for example, prior to, following or simultaneously with the impregnation of the rhenium and platinum metals. In the usual operation, the halogen component is introduced simultaneously with the incorporation of the platinum metal component. It can also be introduced by contacting a carrier material in a vapor phase or liquid phase with a halogen compound such as hydrogen fluoride, hydrogen chloride, ammonium chloride, or the like.

The catalyst can be dried by heating at a temperature above about 80° F., preferably between about 105° F. and 300° F., in the presence of nitrogen or oxygen, or both, in an air stream or under vacuum. The catalyst need not be calcined but if calcined at temperatures in excess of 600° F., it is generally preferred to calcine in atmospheres containing low partial pressures of oxygen or still more preferably in a non-reactive or inert gas such as nitrogen.

Sulfur is a highly preferred component of the catalyst employed in accordance with this invention, because the most significant yield and stability credits are obtained with sulfided catalysts. The sulfur content of the catalyst generally ranges to about 0.2 percent, preferably from about 0.05 to about 0.2 percent, and more preferably from about 0.05 percent to about 0.15 percent, based on the weight of the catalyst (dry basis). The sulfur can be added to the catalyst by conventional methods, suitably by breakthrough sulfiding of a bed of the catalyst with a sulfur-containing gaseous stream, e.g., hydrogen sulfide in hydrogen, performed at temperatues ranging from about 350° F. to about 1050° F. and at pressures ranging from about 1 to about 40 atmospheres for the time necessary to achieve breakthrough, or the desired sulfur level.

In initiating a reforming operation, the dry, reduced, sulfided catalyst is charged into the reactors of a unit. The on-oil portion of the operating cycle is initiated by introducing the hydrogen, then the feed, by adjusting the hydrogen and feed rates, and the temperature and pressure to bring the unit to operating conditions. During the start-up period, preferably at oil-in or slightly thereafter when aromatics have begun to form, particularly when the major operating variables have reached the levels required for normal operating conditions, water is added with the hydrogen and naphtha feed introduced into the unit. Optimum reforming conditions are attained by adjustment of the major process variables, within the ranges described below.

| Major Operating Variables | Typical Process Conditions | Preferred Process Conditions |
|---|---|---|
| Pressure, Psig | 50–750 | 100–300 |
| Reactor Temp., °F. | 750–1100 | 850–1000 |
| Gas Rate, SCF/B (Incl. Recycle Gas) | 1500–10,000 | 2000–7000 |
| Feed Rate, W/W/Hr. | 0.5–10 | 1–3 |

The invention will be more fully understood by reference to the following demonstrations and examples which present comparative data illustrating its more salient features. All units are in terms of weight except as otherwise specified.

EXAMPLES 1–2

Heptane was reformed over chlorided (0.9 wt. % Cl) platinum-rhenium (0.3 wt. % Pt/0.3 wt. % Re) catalysts, supported on alumina, at the conditions given in Table I. Two base runs were first made, these runs representing operation under dry conditions where the $H_2$ contains 4–10 ppm $H_2O$ and the feed approximately 15 ppm $H_2O$. The two sulfided 0.3 Pt-0.3 Re-0.9 Cl catalysts were selected, and serve to illustrate the range of performance frequently observed for such catalysts.

Wet start-up runs were made by the addition of water to the $H_2$ feed by means of an in-line water saturator. A level of 2600 ppm $H_2O$ was maintained for the first 30 minutes on-oil. On cessation of the water addition in these runs, the system returned to dry conditions in less than 15 minutes. The reforming data given in Table I was taken after 6 hours of dry operation.

TABLE I

Heptane Reforming
Over Chlorided, Sulfided Pt—Re Catalysts
(0.3 Wt. % Pt/0.3 Wt. % Re)
100 psig, 500° C., 10 W/H/W, $H_2$/oil = 5

| | Run Description | | | |
|---|---|---|---|---|
| | Base Runs | | Wet Start-up(1) | |
| | Catalyst Pretreatment(2) | | | |
| Heptane Reforming Yields, Wt. % | A | B | A | B |
| $C_1$ | 1.52 | 1.32 | 1.12 | 1.01 |
| n-$C_4$ | 7.15 | 5.66 | 5.23 | 4.59 |
| i-$C_4$ | 3.61 | 3.61 | 3.38 | 3.42 |
| Toluene | 29.2 | 27.5 | 26.3 | 26.6 |
| $C_5$+ | 75.6 | 79.0 | 80.8 | 82.2 |

(1)2600 ppm $H_2O$ present during first 30 minutes on-oil.
(2)A = reduction at 700° F. for 1 hour followed by breakthrough sulfiding at 700° F.
B = reduction at 932° F. for 17 hours followed by breakthrough sulfiding at 932° F.

The wet start-up treatments given the catalysts, as shown by the data, significantly lowers the metal cracking activity of the catalysts as indicated by the lower methane and n-butane yields. Acid cracking, as indicated by the isobutane product, is lowered slightly by the wet start-up as a result of a small amount of chloride stripping. As a result of the drop in metal cracking, $C_5$+ yields show large improvements with the wet start-up. Toluene yields are lower after wet start-up but the difference in yield of this product is much less significant than the difference in methane and n-butane yields.

Substantial yield credits are also observed for naphtha reforming with a wet start-up. Stability credits are also obseved by reference to these data. Although initial activity is slightly lower after wet start-up, the loss in activity with time is smaller compared to catalysts with a normal dry start-up. In agreement with this prediction, small stability credits were actually observed in the heptane reforming runs.

Generally all rhenium-containing catalysts benefit from a wet start-up. The mechanism involved is not firmly established, but it is clear that exposure to water has a permanent impact on metal activity: metal cracking is lowered and dehydrocyclization is stabilized. A change in metal crystallite composition, structure, or interaction with the support has apparently occurred, and it is clear that the presence of Re in the metal crystallite is involved.

EXAMPLE 3

A 0.3 Pt-0.3 Re-1.0 Cl-$Al_2O_3$ reforming catalyst was air activated at 950° F. for 3 hrs., reduced in $H_2$ at 850° F. for 0.5 hr., and sulfided at 850° F. The catalyst was divided into several portions and used to reform a nil sulfur, Light Arabian paraffinic naphtha (Table II) at semi-regenerative conditions of 930° F., 200 psig, 5000 SCF/B, 1.4 W/H/W selected to produce 100 RONC reformate.

TABLE II

Feedstock Inspections

| | |
|---|---|
| ASTM Distillation, °F. | |
| Initial | 147 |
| 10 | 155 |
| 20 | 181 |
| 30 | 200 |
| 40 | 216 |
| 50 | 235 |
| 60 | 255 |
| 70 | 276 |
| 80 | 298 |

TABLE II-continued

Feedstock Inspections

| | |
|---|---|
| 90 | 317 |
| Final B.P. | 355 |
| Octane Number, RON Clear | 49 |
| Gravity, °API | 59.7 |
| Sulfur, Wt. ppm | <0.1 |
| Water, Wt. ppm | 4 |
| Chlorine, Wt. ppm | <0.1 |
| Analysis, Volume Percent | |
| Paraffins | 58.4 |
| Naphthenes | 29.7 |
| Aromatics | 11.9 |

The start-of-run performance of this catalyst measured at 75 hrs. on-oil is provided in Table III. At no time was this catalyst exposed to a wet $H_2$ stream.

TABLE III

On-Oil $H_2O$ Addition Increases $C_5$+and Aromatic Yield
by Supressing Hydrocracking
Nil Sulfur Paraffinic Naphtha,
930° F., 200 psig, 5000 SCF/B, 1.4 W/H/W,
100 RON, 75 hrs. On Oil

| Example | 3 | 4 | 5 | 6 | 7 | 8 | 9(a) |
|---|---|---|---|---|---|---|---|
| Wet $H_2$ Treat | | | | | | | |
| Length, Minutes | — | 5 | 10 | 10 | 30 | — | 10 |
| Temperature, °F. | — | 930 | 930 | 930 | 930 | — | 930 |
| Time On-oil, Minutes | — | 0 | 0 | 30 | 30 | 0 | 0 |
| Yield, Wt. % on Feed | | | | | | | |
| $C_1$+ | 2.7 | 2.3 | 2.2 | 2.3 | 2.1 | 2.6 | 1.5 |
| $C_5$ | 77.1 | 77.6 | 78.5 | 77.2 | 78.7 | 75.9 | 80.6 |
| Aromatics | 54.2 | 54.9 | 55.0 | 55.1 | 54.7 | 53.7 | 55.7 |
| $C_9$+Aromatic Selectivity, Wt. % | 25.9 | 28.6 | 28.5 | 28.7 | 28.4 | 26.9 | 31.6 |
| Relative Activity | 1.4 | 1.4 | 1.4 | 1.4 | 1.4 | 1.0 | 1.4 |

(a)99 RON reformate.

EXAMPLE 4

A portion of the 0.3 Pt-0.3 Re catalyst of Example 3 was used to reform the same paraffinic naphtha. In this case the catalyst was treated with wet $H_2$ for 5 mins. at start-of-run (time on-oil at 930° F.=0). Metal hydrocracking was suppressed as evidenced by the decline in methane yield, the most sensitive, diagnostic probe of metal site cracking. As a consequence of metal cracking suppression, the yields of $C_5$+ liquid, and product aromatics increase over the base case (Table III, Example 3). The shift in the selectively to $C_9$+ aromatics is another indication of cracking suppression. This shift reflects the preservation and aromatization of heavy feed paraffins rather than their degradation by cracking to light aromatic precursors.

EXAMPLE 5

The procedure of Example 4 was repeated except that the duration of the exposure to wet $H_2$ was extended to 10 mins. Additional suppression of hydrocracking occurs as shown by increasing $C_5$+ liquid yields (Table III, Example 5).

EXAMPLE 6

The general procedure of Example 4 was again repeated. In this case the catalyst was treated with wet $H_2$ for 10 mins. after reforming had been in progress for 30 mins. Results similar to those previously described are observed by reference to Table III, Example 6.

EXAMPLE 7

The procedure of Example 6 was repeated except that the duration of the wet $H_2$ treat was extended to 30 mins. after 30 mins. on-oil. The results are given by further reference to Table III.

EXAMPLE 8

A sample of the 0.3 Pt-0.3 Re catalyst was air activated and reduced and sulfided at 700° F. This pretreatment yields a catalyst inferior to that of Example 3. Cracking activity is greater leading to depressed $C_5$+ and aromatic yields relative to the base case. Reference is again made to Table III.

EXAMPLE 9

A catalyst pretreated as in Example 8 was used to reform the paraffinic naphtha according to the procedure of Example 5. The effects of the water addition in this case are significant providing liquid and aromatic yields comparable to those of Examples 4–7. Correcting the $C_5$+ yield from 99 to 100 RON gives a value of approximately 78.6 wt. % consistent with those of the other examples employing water addition and superior to that of the base case. This example, Example 9, illustrates the ability of the wet $H_2$ treat to compensate for improper catalyst pretreatment.

In Examples 3–7 the relative catalyst activities after 200–300 hrs. on-oil reveal no adverse sensitivity to on-oil water addition. The catalyst of Example 8, however, due to its high cracking activity suffers a stability penalty which is negated by the wet $H_2$ treat (Example 9).

The following example demonstrates the necessary presence of aromatics during water addition in order to achieve permanent cracking reduction.

EXAMPLE 10

Three runs were performed by passing heptane, pentane, and pentane containing 20 vol. % toluene over sulfided 0.3% Pt/0.3% Re/0.9% Cl-$Al_2O_3$ catalysts at the conditions shown in Table IV. After running about two hours, the $H_2$ feed was switched from dry to wet (2600 ppm $H_2O$) for a period of about two more hours then switched back to dry conditions to determine if cracking was reduced by the water treatment. As shown in Table IV, cracking is permanently lowered in the case of heptane (where toluene is formed in situ by dehydrocyclization) and in the case of toluene-spiked pentane. Since there are no aromatics added or formed in situ with pentane alone, as shown by the data, cracking activity was not reduced by the water treat.

TABLE IV

| 100 psig, 500° C., 10 W/H/W, $H_2$/Oil = 5 | | | |
|---|---|---|---|
| | Wt. % Cracking | | % Cracking Suppressed by |
| Feed | Before $H_2O$ | After $H_2O$ | $H_2O$ Treat |
| Heptane | 32.5 | 27.2 | 16 |
| Pentane | 21.1 | 23.2 | 0 |
| Pentane-20% Toluene | 11.8 | 10.0 | 15 |

It is apparent that various modifications and changes can be made in the process, and compositions without departing the spirit and scope of the invention.

Having described the invention, what is claimed is:

1. In a process for improving the octane quality of a naphtha in a reforming unit comprised of one or a plurality of serially connected reactors which contain a halogenated rhenium-containing catalyst, hydrogen is introduced into the unit, the unit is brought on stream by introducing said naphtha into the unit, and the unit brought to reforming conditions to initiate start-up of the unit the improvement comprising adding water during the start-up period, while the hydrogen and naphtha are concurrently added to the unit, in concentration ranging from about 100 vppm to about 10,000 vppm of hydrogen, sufficient to produce decline of the hydrocracking activity of the catalyst, and methane production decline, and then discontinuing the water addition after methane production begins to level out, while continuing to add dry hydrogen and naphtha to the unit.

2. The process of claim 1 wherein the halogenated rhenium-containing catalyst is comprised of platinum and rhenium.

3. The process of claim 2 wherein the catalyst contains from about 0.01 percent to about 3 percent platinum, and from about 0.01 percent to about 3 percent rhenium, based on the weight of the catalyst.

4. The process of claim 3 wherein the catalyst contains from about 0.05 percent to about 1 percent platinum, and from about 0.05 percent to about 1 percent rhenium.

5. The process of claim 1 wherein the halogenated rhenium-containing catalyst contains chloride in concentration ranging from about 0.1 percent to about 3 percent, based on the weight of the catalyst.

6. The process of claim 5 wherein the catalyst contains from about 0.2 to about 2 percent chloride.

7. The process of claim 1 wherein the halogenated rhenium-containing catalyst contains sulfur in concentration ranging up to about 0.2 percent, based on the weight of the catalyst.

8. The process of claim 1 wherein water is added on initiation of the start-up period, when the naphtha is first introduced into the unit and the production of aromatics has begun.

9. The process of claim 1 wherein water is added to the unit in concentration ranging from about 100 vppm to about 5000 vppm of hydrogen.

10. In a process for improving the octane quality of a naphtha in a reforming unit comprised of a plurality of serially connected reactors which contain a halogenated platinum-rhenium catalyst, hydrogen is introduced into the unit, the unit is brought on stream and a naphtha introduced into a reactor of the unit, the hydrogen and naphtha passing from one reactor of the series to the next, at reforming conditions to initiate start-up of the unit the improvement comprising adding water during the start-up period, while the hydrogen and naphtha are concurrently added to the reactors of the unit, in concentration ranging from about 100 vppm to about 10,000 vppm of hydrogen sufficient to produce decline of the hydrocracking activity of the catalyst, and methane production decline, and then discontinuing the water addition after methane production begins to level out, while continuing to add dry hydrogen and naphtha to the unit.

11. The process of claim 10 wherein the halogenated catalyst contains from about 0.05 percent to about 1 percent platinum, and from about 0.05 percent to about 1 percent rhenium, based on the weight of the catalyst.

12. The process of claim 10 wherein the catalyst is a chlorided platinum-rhenium catalyst.

13. The process of claim 10 wherein the halogenated platinum-rhenium catalyst contains chloride in concentration ranging from about 0.2 percent to about 2 percent, based on the weight of the catalyst.

14. The process of claim 10 wherein the halogenated platinum-rhenium catalyst is sulfided, and contains sulfur in concentration ranging from about 0.05 percent to about 0.15 percent, based on the weight of the catalyst.

15. The process of claim 10 wherein water is added on initiation of the start-up period, when naphtha is initially charged into the unit and aromatics production has begun.

16. The process of claim 10 wherein water is added to the unit in concentration ranging from about 100 vppm to about 5000 vppm of hydrogen.

17. The process of claim 1 wherein the water is added, during the start-up period, to the initial reactor of the series.

18. The process of claim 10 wherein the water is added, during the start-up period, to the initial reactor of the series.

* * * * *